US007731545B1

(12) United States Patent
Scholeno

(10) Patent No.: US 7,731,545 B1
(45) Date of Patent: Jun. 8, 2010

(54) LAMP SOCKET AND CONTACT FOR SAID SOCKET

(75) Inventor: Michael F. Scholeno, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 12/380,218

(22) Filed: Feb. 25, 2009

(51) Int. Cl.
*H01R 24/00* (2006.01)

(52) U.S. Cl. ..... 439/699.2; 439/619

(58) Field of Classification Search ..... 439/699.1, 439/699.2, 616, 619
See application file for complete search history.

(56) References Cited

U.S. PATENT DOCUMENTS

| | | | | |
|---|---|---|---|---|
| 4,256,989 | A | 3/1981 | Trutner et al. | |
| 4,899,266 | A | 2/1990 | Ahroni | |
| 5,216,319 | A | 6/1993 | Van Heeswijk | |
| 5,313,134 | A | 5/1994 | Borgis et al. | |
| 5,924,882 | A | 7/1999 | Slazakowski | |
| 6,162,079 | A | 12/2000 | Slazakowski | |
| 6,791,244 | B2 | 9/2004 | Linssen | |
| 7,025,634 | B1 * | 4/2006 | Swantner et al. | 439/619 |
| 7,080,923 | B2 | 7/2006 | Plunk et al. | |
| 7,097,489 | B2 * | 8/2006 | Yen et al. | 439/336 |
| 7,222,987 | B2 * | 5/2007 | Tseng | 362/219 |

(Continued)

FOREIGN PATENT DOCUMENTS

EP 101257 A1 2/1984

(Continued)

OTHER PUBLICATIONS

Socket description, Bender & Wirth, Fassung (Lampholder) PGJ28 und PGJX28, Fassungstechnik, 1 page.

(Continued)

*Primary Examiner*—Ross N Gushi
(74) *Attorney, Agent, or Firm*—William H. McNeill

(57) ABSTRACT

A socket (10) for receiving and retaining a lamp (12) and providing electrical connection to electrical lead-ins (14*a*) and (14*b*) of the lamp (12), the electrical lead-ins (14*a*) and (14*b*) projecting from the lamp in a direction orthogonal to a longitudinal axis (18). The socket (10) comprises a first socket body half (16) arrayed about the longitudinal axis (18) and including a receptacle (20) aligned with the longitudinal axis (18) for receiving a portion (22) of the lamp (12). Lead-in receptacles (24) are formed in the socket body (16), the receptacles being laterally disposed relative to the longitudinal axis. Electrical lead-in contact receivers (26) are formed adjacent the lead-in receptacles. Radially spaced contact retainers (28, 29) are associated with the contact receivers (26). An electrical contact (30) is positioned in each contact receiver (26), each of the electrical contacts (30) comprising first and second spaced-apart lead-in engagers (32, 34) joined by a bight (36). A tab (38) extends from a distal end (40) of the first lead-in engager (32) and is confined in the contact retainer (29) and a tab (42) extends from a proximal end (44) of the second lead-in engager (34). A wire receptor (46) is affixed to the contact (30). A second socket body half (48) is affixed to the first socket body half (16) and a contact retention spring (50) is positioned between an inside surface (52) of the second socket body half and first lead-in engager (32).

4 Claims, 3 Drawing Sheets

U.S. PATENT DOCUMENTS

| | | | | |
|---|---|---|---|---|
| 7,399,191 | B1 * | 7/2008 | Scholeno | 439/232 |
| 7,441,939 | B2 | 10/2008 | Scholeno | |
| 7,530,849 | B2 * | 5/2009 | Colosio | 439/619 |
| 2001/0000766 | A1 * | 5/2001 | Tanigawa | 439/459 |
| 2003/0076025 | A1 | 4/2003 | Meinecke | |
| 2004/0032738 | A1 | 2/2004 | Harnischmacher | |
| 2006/0292914 | A1 | 12/2006 | Verspaget | |
| 2008/0094856 | A1 | 4/2008 | Garcia et al. | |
| 2008/0132117 | A1 * | 6/2008 | Colosio | 439/619 |

FOREIGN PATENT DOCUMENTS

| | | | |
|---|---|---|---|
| EP | 0871264 | A1 | 10/1998 |
| GB | 850069 | | 9/1960 |
| WO | 03056237 | A1 | 7/2003 |
| WO | 2005025014 | A1 | 3/2005 |

OTHER PUBLICATIONS

Socket description, Bender & Wirth, Fassung (Lampholder) PGJ50/PGJX50, Fassungstechnik, 3 pages.

* cited by examiner

LAMP SOCKET AND CONTACT FOR SAID SOCKET

TECHNICAL FIELD

This application relates to electrical sockets and more particularly to electrical sockets for solidly receiving and mounting an electric lamp.

BACKGROUND ART

The mounting and connection of high-power lamps in ceramic sockets has presented many problems over the years. The use of ceramic materials, which have greater tolerances than counterpart plastic materials, has necessitated great complexity in the contacts employed in order to ensure both adequate electrical contact as well as mechanical holding ability. Often, in high-power lamps, the electrical lead-ins extend in a direction normal to the lamp axis and, this, too, has presented problems.

DISCLOSURE OF INVENTION

It is, therefore, an object of the invention to obviate the disadvantages of the prior art.

It is another object of the invention to improve lamp mounting.

It is yet another object of the invention to enhance lamp mounting and lamp sockets.

These objects are accomplished, in one aspect of the invention, by the provision of a socket for receiving and retaining a lamp and providing electrical connection to electrical lead-ins and of the lamp, the electrical lead-ins projecting from the lamp in a direction orthogonal to a longitudinal axis, the socket comprising: a first socket body-half arrayed about the longitudinal axis and including a receptacle aligned with the longitudinal axis for receiving a portion of the lamp; lead-in receptacles formed in the socket body, the receptacles being laterally disposed relative to the longitudinal axis; electrical lead-in contact receivers formed adjacent the lead-in receptacles; first and second radially spaced contact retainers associated with the contact receivers; an electrical contact positioned in each contact receiver, each of the electrical contacts comprising first and second spaced-apart lead-in engagers joined by a bight; a first tab extending from a distal end of the first lead-in engager and confined in the first radially spaced contact retainer; a second tab extending from a proximal end of the second lead-in engager and confined in the second radially spaced contact retainer; a wire receptor affixed to the contact; a second socket-body half affixed to the first socket body-half; and a contact retention spring positioned between an inside surface of the second socket body half and the first lead-in engager.

In addition to other features, which will be explained hereinafter, the use of the radially spaced contact retainers and the first and second tabs formed on the contacts provides superb contact location and alignment and the contact retention spring maintains this critical alignment.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
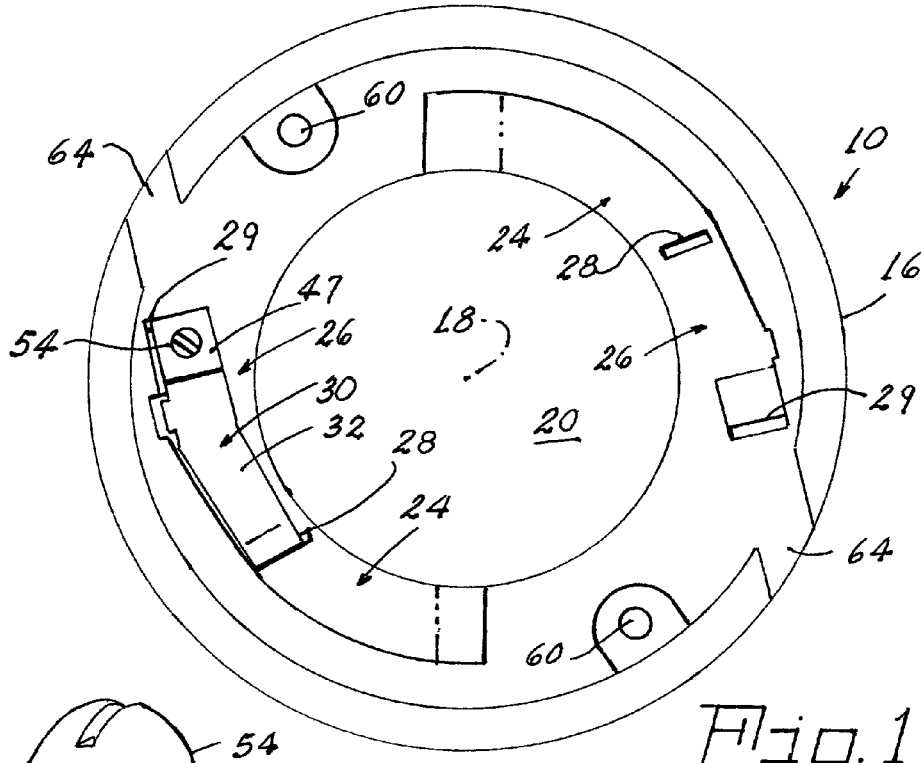
FIG. 1 is a plan view of a first socket body half.
Figure 5:
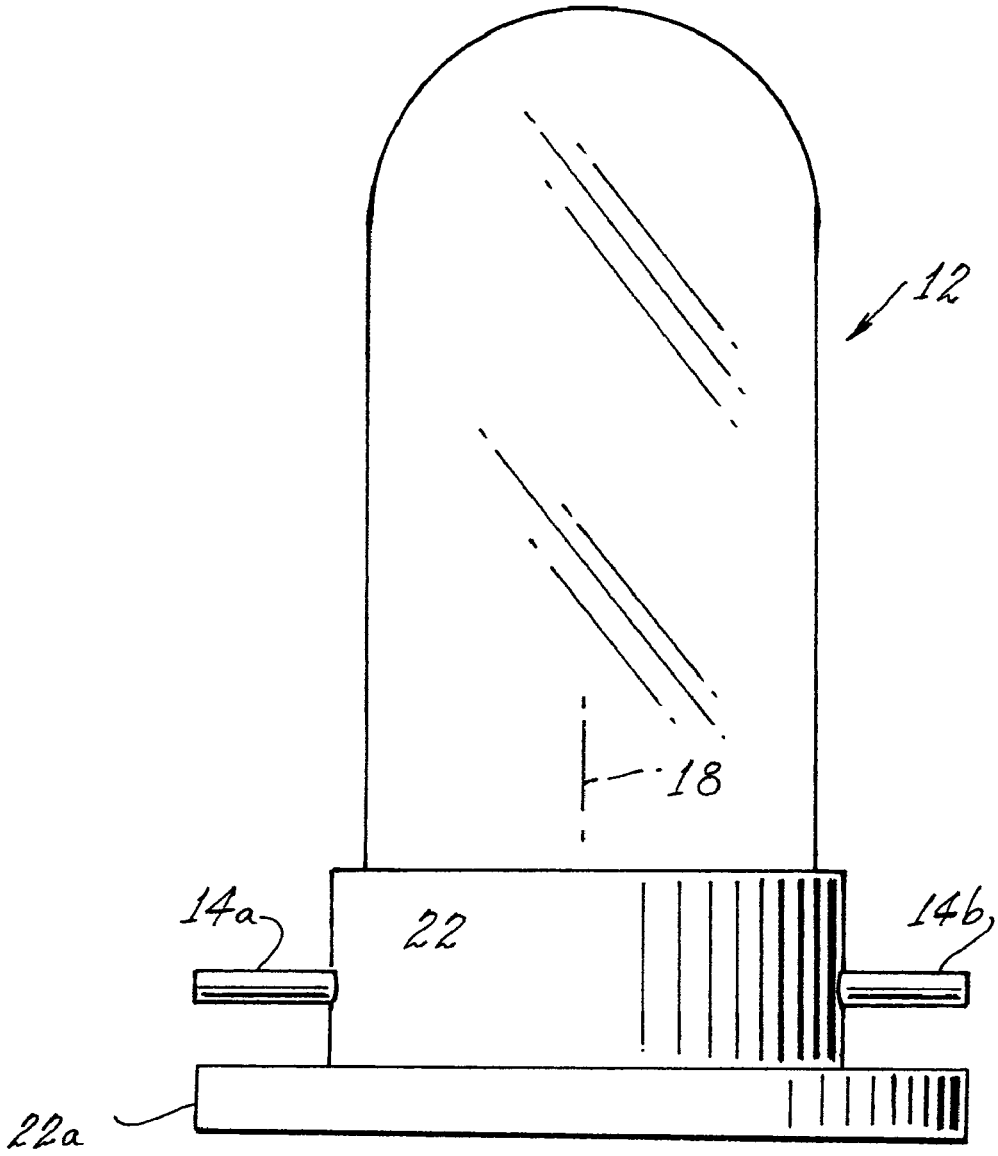
FIG. 5 is an elevation view of a lamp employable with the socket.

Referring now to the drawings with greater particularity, there is shown in FIG. 1 a socket 10 for receiving and retaining a lamp 12 (see FIG. 5) and providing electrical connection to electrical lead-ins 14*a* and 14*b* of the lamp 12. The electrical lead-ins 14*a* and 14*b* project from the lamp in a direction orthogonal to a longitudinal axis 18. The socket 10 comprises a first socket body half 16 arrayed about the longitudinal axis 18 and includes a receptacle 20 aligned with the longitudinal axis 18 for receiving a portion 22 of the lamp 12. Portion 22 of the lamp 12 includes a flange 22*a*. When lamp 12 is a high power lamp, the socket body is fabricated from a ceramic material, such as, for example, steatite.

Figure 2:
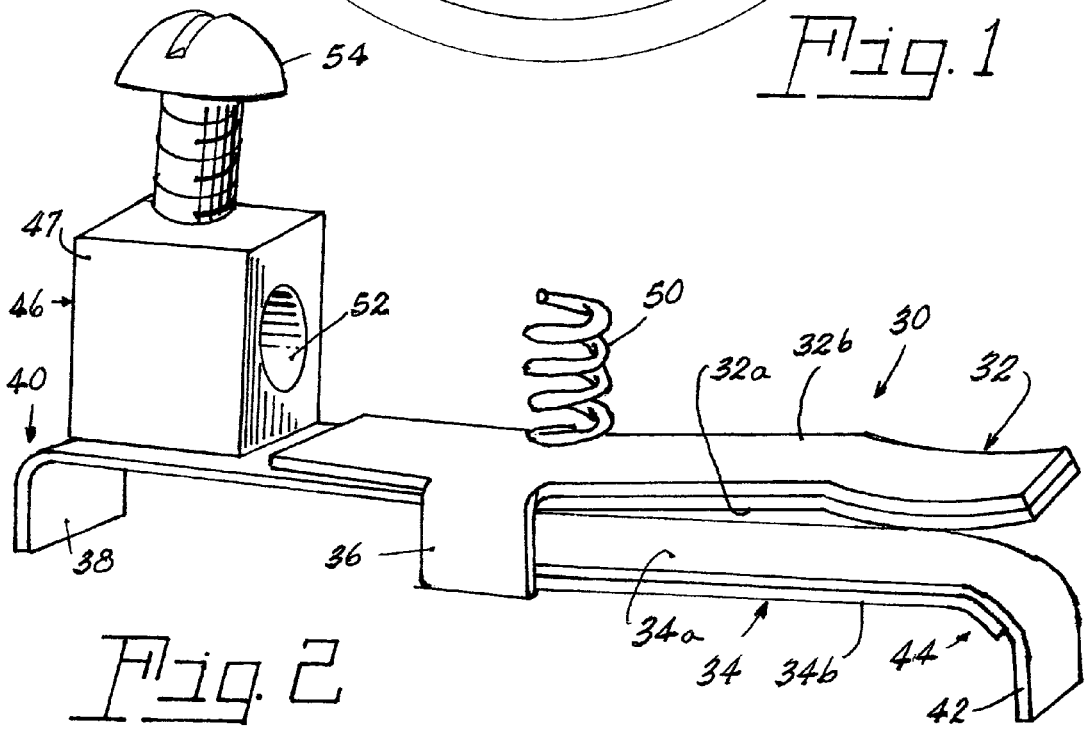
FIG. 2 is a perspective view of a contact used with the socket body half.
Figure 3:
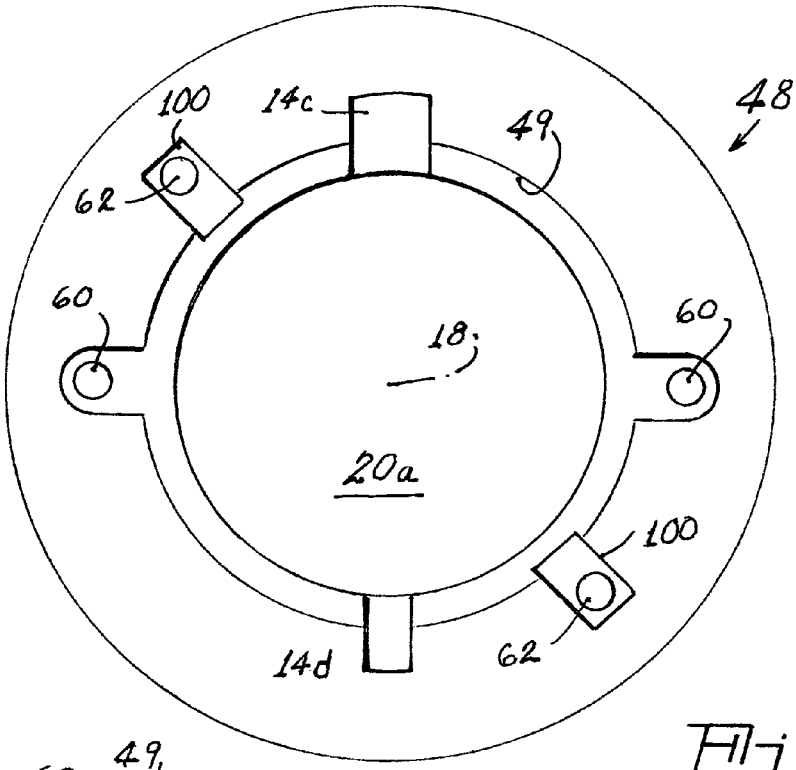
FIG. 3 is plan view of a second body half.
Figure 4:
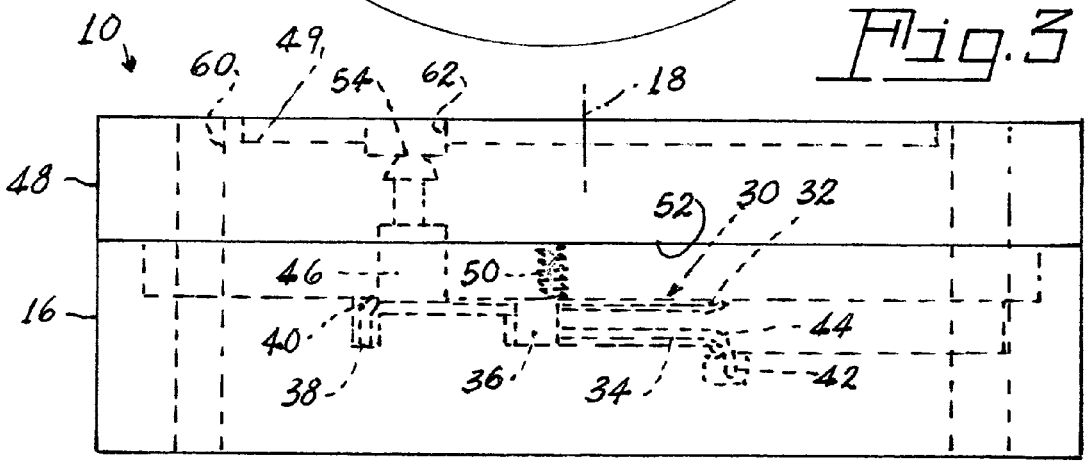
FIG. 4 is an elevation view of an assembled socket.

Lead-in receptacles 24 are formed in the socket body 16, the receptacles being laterally disposed relative to the longitudinal axis 18. Electrical lead-in contact receivers 26 are formed adjacent the lead-in receptacles. Radially spaced contact retainers 28, 29, in the form of slots are associated with the contact receivers 26 and electrical contacts 30 positioned in each contact receiver 26. In the interest of clarity, only one electrical contact 30 is shown in FIG. 1. Each of the electrical contacts 30 (shown in FIG. 2) comprises first and second spaced-apart lead-in engagers 32, 34 joined by a bight 36. Preferably, the lead-in engagers comprise a nickel contact 32*a*, 34*a* covered by a strengthening material 32*b*, 34*b*, such as stainless steel.

A tab 38 extends from a distal end 40 of the first lead-in engager 32 and is confined in the contact retainer 29 and a tab 42 extends from a proximal end 44 of the second lead-in engager 34 and is confined in contact retainer 28. These features locate and retain the electrical contacts 30 in the proper position.

A wire receptor 46 is affixed to each of the contacts 30, for example, at the distal end 40 of the first lead-in engager 32. The wire receptor 46 comprises an electrically conductive body 47 including a wire-receiving aperture 52 and a wire securer, such as threaded member 54.

A second socket body half 48 is affixed to the first socket body half 16 and includes a receptacle 20*a* and lead-in receptors 14*c* and 14*d*. A circular groove 49 receives the flange 22*a*. A contact retention spring 50 is positioned between an inside surface 52 of the second socket body half 48 and the first lead-in engager 32. The spring 50 aids in the positioning of the contacts 30 and adds increased resistance to the engagers to aid in maintaining the lead-ins 14*a* and 14*b* in adequate electrical and mechanical contact.

Suitable through-apertures 60 are provided in the socket halves for the reception of connecting means, such as bolts, not shown, and apertures 62 are provided in the second half 48 to provide access to the wire securers 54. In addition to providing access to the wire securers 54, retaining springs 100 can be fitted into the apertures 62. The springs 62 contact the edge of the flange 22*a* when the lamp 12 is inserted into the socket and limits movement of the lamp by filling any gap that may exist between the lamp flange and the edge of the groove 49.

Channels 64 are provided in the first socket body half for the reception of the connecting wires. These channels 64 lead into the wire-receiving aperture 52 in the wire receptor 46.

Accordingly, there is provided a socket for high power lamps that includes positive positioning for the electrical contacts and extremely firm electrical and mechanical connection for the lamp lead-ins. The electrical contact configuration eliminates many of the problems encountered because of the tolerances necessary with ceramic sockets.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A socket for receiving and retaining a lamp and providing electrical connection to electrical lead-ins and of the lamp, said electrical lead-ins and projecting from said lamp in a direction orthogonal to a longitudinal axis, said socket comprising:

a first socket body portion arrayed about said longitudinal axis and including a receptacle aligned with said longitudinal axis for receiving a portion of the lamp;

lead-in receptacles formed in said socket body, said receptacles being laterally disposed relative to said longitudinal axis;

electrical lead-in contact receivers formed adjacent said lead-in receptacles;

first and second radially spaced contact retainers associated with said contact receivers;

an electrical contact positioned in each contact receiver, each of said electrical contacts comprising first and second spaced-apart lead-in engagers joined by a bight;

a first tab extending from a distal end of said first lead-in engager and confined in said first radially spaced contact retainer;

a second tab extending from a proximal end of said second lead-in engager and confined in said second radially spaced contact retainer;

a wire receptor affixed to said contact;

a second socket body portion affixed to said first socket body portion; and a contact retention spring positioned between an inside surface of said second socket body portion and first lead-in engager.

2. The socket of claim 1 wherein said first and second lead-in engagers comprise and inner layer of a first material and an outer layer of a second material.

3. The socket of claim 2 wherein said inner layer is nickel and said outer layer is stainless steel.

4. The socket of claim 1 wherein said wire receptor comprises an electrically conductive body including a wire receiving aperture and a wire securer.

* * * * *